US006009854A

United States Patent [19]

Rösgren et al.

[11] Patent Number: 6,009,854

[45] Date of Patent: Jan. 4, 2000

[54] ARRANGEMENT FOR A INJECTION PUMP IN AN INTERNAL COMBUSTION ENGINE

[75] Inventors: Carl-Erik Rösgren, Vikby; David C. Jay; Matti Vaarasto, both of Vähäkyrö, all of Finland

[73] Assignee: Wartsila NSD OY AB, Helsinki, Finland

[21] Appl. No.: 09/026,470

[22] Filed: Feb. 19, 1998

[30] Foreign Application Priority Data

Feb. 20, 1997 [FI] Finland ..... 970708

[51] Int. Cl.[7] ..... F02M 37/04

[52] U.S. Cl. ..... 123/456; 123/506; 123/468

[58] Field of Search ..... 123/456, 468, 123/469, 506, 467

[56] References Cited

U.S. PATENT DOCUMENTS 5,036,821 8/1991 Horiuchi et al. ..... 123/506

5,325,834 7/1994 Ballheimer et al. ..... 123/456

*Primary Examiner*—Thomas N. Moulis

*Attorney, Agent, or Firm*—Smith-Hill and Bedell

[57] ABSTRACT

An arrangement for an injection pump in an internal combustion engine, especially a large diesel engine, in which the injection pump (2) is provided with a pressure medium controlled feed control valve (11), the flow circuit of which includes a pressure medium source (14), from which pressure medium is pumped through a delivery duct (16*a*) into a feed duct (17, 18, 20, 21, 22, 22*a*), which is provided with a non-return valve (23) and is connected to a pressure chamber (13) affecting said control valve (11) and to a spill passage (24) to be switched off by means of a solenoid valve (25), whereby closing of the solenoid valve (25) is arranged to provide a pressure increase in the pressure chamber (13) and, thus, a change of the state of the control valve (11). Said feed duct (17, 18, 20, 21, 22, 22*a*) between the delivery duct (16*a*) and the control valve (11) is dimensioned to be relatively thin and long and is arranged at least to its main part to be a stationary part of the injection pump (2), of its supporting construction (3) or of a stationary construction unit to be attached to these. Hereby a compact assembly can be provided.

14 Claims, 2 Drawing Sheets

1
1
2
3
4
4'
4a
6
7
8
9
10
11
12
13
14
15
16
16a
17
17
18
19
20
21
22
22a
23
25
26
27
II
II

ARRANGEMENT FOR A INJECTION PUMP IN AN INTERNAL COMBUSTION ENGINE

BACKGROUND OF THE INVENTION

This invention relates to an arrangement for an injection pump in an internal combustion engine.

A large diesel engine refers in this connection to such an engine that may be employed, for example, as the main propulsion engine or the auxiliary engine for a ship or for a power plant for producing electricity and/or heat energy.

In order to control the operation of a fuel injection pump and to provide exact timing for the injection a control valve controlled by a solenoid is with advantage used. Especially in case the fuel to be utilized is heavy fuel, which may cause clogging problems, a spill valve may be utilized as a control valve, the operation of which is controlled by means of a separate pressure medium circuit provided with a solenoid valve so that pressure medium, for instance oil, is continuously fed into the control valve and onward into a spill passage. The injection of fuel is started by closing the solenoid valve, whereby the pressure medium remains in the feed duct between the solenoid valve, a non-return valve and the control valve and provides, due to suitable dimensions of the feed duct, a pressure wave effect closing the control valve. The principles of operation of a system of this kind are described for instance in the publication GB 2279706, which is hereby incorporated by reference for this part.

SUMMARY OF THE INVENTION

An aim of the invention is to provide an improved flow circuit for the pressure medium with its duct arrangements to be utilized for feed control of an injection pump and adaptable especially for the control of a control valve making use of the above mentioned pressure wave effect. An aim is to provide a construction, which requires little space and is easy to manufacture, to install and to service. A further aim is that the arrangement can be adapted for the control of injection valves intended for different kinds of pressure media. A special aim is that the arrangement can be adapted for the control of injection valves for heavy fuel to be utilized especially in large diesel engines.

In accordance with the invention, the feed duct between the delivery duct and the control valve is dimensioned to be relatively thin and long and is arranged at least to its main part to be a stationary part of the injection pump, of its supporting construction or of a stationary construction unit to be attached to these. Hereby the arrangement can be implemented without separate long pipes, which need space and are cumbersome to install and, in addition, are prone to leakage.

In practice the feed duct is with advantage dimensioned so that the volume flow rate therethrough is 5.5–16 l/min and the flow speeds are in the average 7–22 m/s depending on the dimensions in the different parts of the feed duct.

When a significant part of the total length of the feed duct is designed to be arcuate the feed duct can be packed to provide a compact assembly.

A solution advantageous from the viewpoint of manufacture can be accomplished when the feed duct is to its substantial part formed between two surfaces for instance through milling.

In an advantageous embodiment the shape of the feed duct is substantially helical and is arranged between the boundary surfaces of two pipe-like elements arranged in a telescopic manner inside one another. In this case it is sufficient that the feed duct is milled only in either one of the surfaces.

Alternatively the feed duct may comprise a set of at least substantially linear parts, which are joined together in the direction of flow by means of arcuate parts.

The arrangement according to the invention can especially be adapted to a large diesel engine having several cylinders, which are provided with a separate fuel injection pump of their own including a control valve and being assembled to be a stationary part of a so called console support in the engine, which is arranged to support the injection pump units, which are arranged in successive order and connected to each other and include a common fuel feed pipe and additionally a common fuel return pipe with separate connecting ducts to each fuel injection pump, whereby the pressure medium is arranged to be fed through the delivery duct into the pressure medium circuit of each control valve. This kind of system, in which the injection pumps are supported and partly integrated into a console support of an engine, is disclosed in Patent Publication EP 509804, which is incorporated by reference for this part In the case according to the invention a separate pipe element is arranged within the fuel feed pipe or within the fuel return pipe included in the console support so that a part of the feed duct for the control valve is arranged in a helical manner around the pipe element at the boundary surface between the pipe element and the fuel pipe in question. Thus, the feed duct can with advantage be integrated to be part of an injection pump mounted on the console support.

In order to prevent blending of the pressure medium with the fuel to be injected, the inner part of the pipe element serving as a fuel duct inside of the fuel pipe, the feed duct is sealed from the fuel duct preferably by means of ring seals.

In case the engine is provided with a separate feed rail, known as such and extending in the direction of the console support, the delivery duct can with advantage be included in the feed rail to lead the pressure medium from a pressure medium container or from a corresponding pressure medium source into the feed duct. Then the feed opening of the feed duct is arranged with regard to the fuel injection pump at the side of the feed rail. Hereby the portion of separate ducts and the joints related thereto can be minimized. For the same reason the body of the fuel injection pump supported to the console support is with advantage provided with bores for leading pressure medium from the part of the feed duct associated with the pipe element into the solenoid valve. Then also the non-return valve may be arranged in the body of the fuel injection pump.

Oil, especially engine oil, is with advantage utilized as pressure medium, whereby from the control valve the oil can with advantage be led through a separate passage into the vicinity of a roll follower in the fuel pump for providing extra lubrication before recovery and recirculation.

BRIEF DESCRIPTION OF THE DRAWINGS

In the following the invention is described by way of example with reference to the attached drawings, in which.

DETAILED DESCRIPTION

Figure 1:
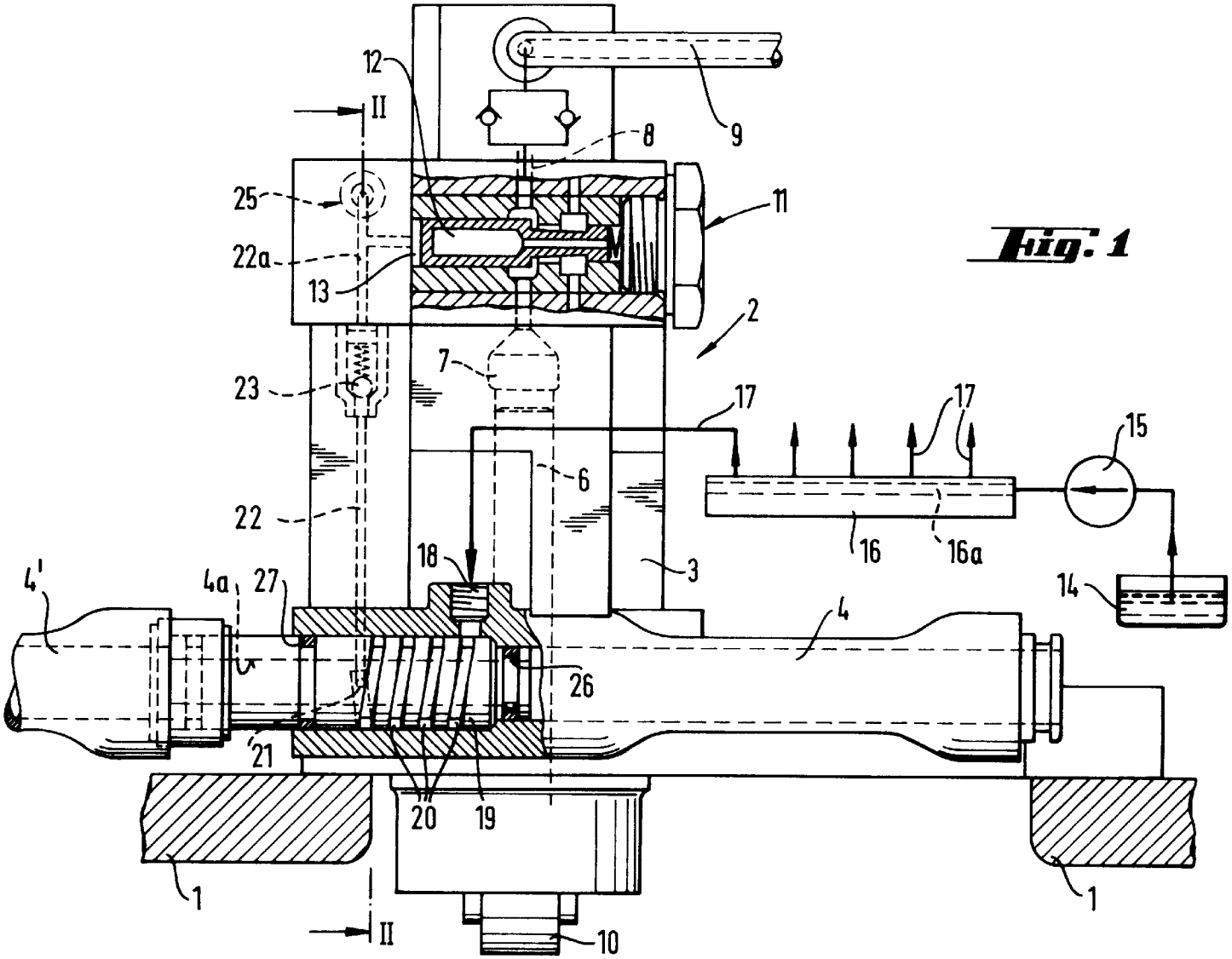
FIG. 1 shows an arrangement according to the invention for the part of one injection pump, as a side view and partly in section.
Figure 2:
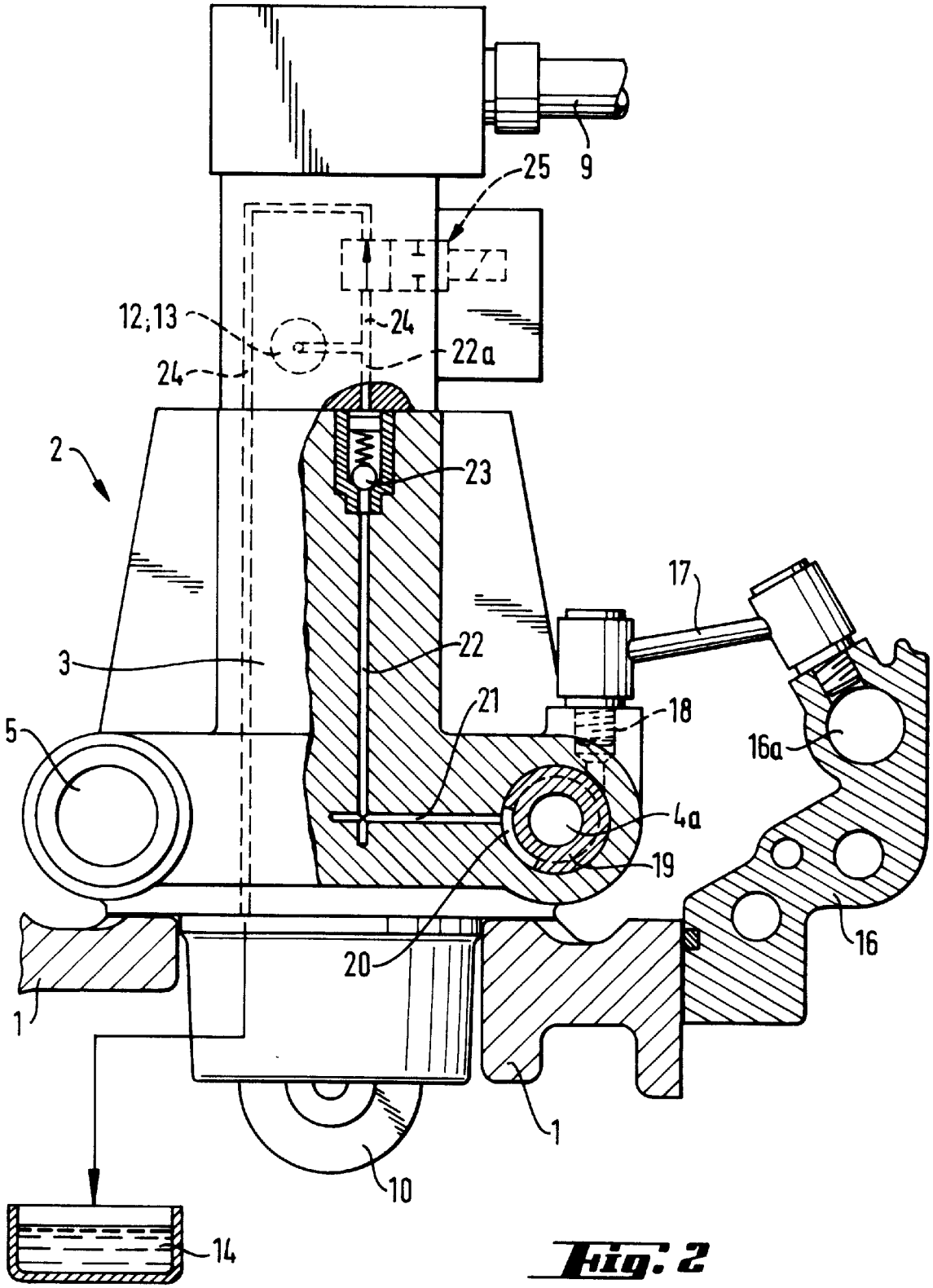
FIG. 2 shows section II—II of FIG. 1.

In the drawing the reference numeral 1 indicates a so called console support to be utilized especially in a large diesel engine and which can be a stationary part of a not-shown engine block or a unit to be separately mounted thereto and to which an injection pump is to be mounted for each cylinder in the engine block. For clarity the figures show only one injection pump 2, the body 3 of which includes as a stationary part a fuel feed pipe 4 and a fuel return pipe 5 (FIG. 2). The feed pipes for the separate injection pumps are connected together to form a uniform fuel feed pipe, for example in a way known from Patent Publication EP 509804, from which fuel is separately led into each injection pump (not shown). For a matter of illustration FIG. 1 shows a segment of a fuel feed pipe 4' of the adjacent injection pump. Correspondingly, excess fuel is led back for recirculation by means of successive return pipes connected together.

The injection pump 2 includes a piston member 6 movable inside the body 3 and the movements of which are guided by a roll follower 10, which receives its guidance from a not-shown cam shaft, and a pressure chamber 7, from which fuel is led through a duct 8 and a pipe 9 to an injection nozzle (not shown) to be injected into a cylinder of the engine. Exact timing for the injection is provided by utilizing a feed control valve 11, which is located transversely relative to the duct 8 and the operation of which is apparent for instance from the publication GB 2279706, so it is not described more closely here.

The invention relates actually to the flow circuit of the pressure medium controlling the operation of the feed control valve 11, which includes a pressure medium container 14, from which a pump 15 pumps pressure medium into a separate feed rail 16 (shown only schematically in FIG. 1), which is supported to the console support 1 and which can be utilized for transferring different pressure media related to the engine and to its systems. From a delivery duct 16a in the feed rail the pressure medium is led further into each injection pump by utilizing feed ducts 17.

As is apparent from the figures the feed duct 17 is fixed to a feed opening 18 made in the body 3 of the injection pump and leading the pressure medium into a duct 20 located in a helical manner around the fuel duct 4a in the fuel feed pipe 4. From the duct 20 the pressure medium is led further through ducts 21 and 22 made as bores in the body 3 and through a duct 22*a* into a pressure chamber 13 affecting the control valve 11 and on the other hand through a spill passage 24 back for recirculation. The spill passage 24 leads the pressure medium into the vicinity of the roll follower 10 in the injection pump for providing extra lubrication before recovery.

The duct 22 is provided with a non-return valve 23 and the passage 24 with a solenoid valve 25. When the solenoid valve 25 closes, the pressure medium is reflected backwards through a part of the passage 24 and the duct 22*a* so that the non-return valve 23 closes. Under the influence of pressure waves resulting therefrom the pressure in the part 22*a* of the duct 22 and in the chamber 13 increases and moves a valve member 12 of the control valve to the right in FIG. 1 into a position providing transfer of fuel from the chamber 7 via the duct 8 to be injected into the cylinder of the engine. Correspondingly, when the solenoid valve 25 opens, the control valve 11 returns to its original condition, in which the connection of the fuel through the duct 8 is switched to the normal fuel feed pressure thus ending at the same time injection of the fuel.

In order to provide a reliable operation for the control valve 11 the connection of the pressure medium between the feed rail 16 and the chamber 13 of the control valve is to be relatively long and narrow so that the kinetic energy of the flow is suitable in this part of the flow circuit. For this reason and for minimizing the utilization of space and the different connections the ducts 20, 21, 22 and 22*a* and the passage 24 are integrated in the body 3 of the injection pump. Especially the helical form of the duct 20 is of advantage from the viewpoint of both the flow and the utilization of space.

In practice the duct 20 is accomplished by arranging inside of the feed pipe 4 a separate pipe element 19, into which a helical groove is milled forming together with the inner surface of the feed pipe 4 the duct 20. The pipe element 19 is pressure tight and additionally sealed at its both ends from the actual fuel flow duct 4a by means of ring seals 26 and 27. When desired the duct 20 can as well be provided in connection with the return pipe for fuel, especially if instead of the feed pipe 4 the return pipe 5 is located closest to the feed rail 16. The helical groove may also be milled to the inner surface of the feed pipe 4 or the return pipe 5.

In the arrangement according to the invention the volume flow rate in the ducts 17, 18, 20, 21, 22 and 22*a* forming the feed duct is typically in the order of 5.5–16 l/min and the flow speeds are in the average 7–22 m/s depending on the dimensions in the different pressure medium ducts. The arrangement ensures that if the pressure in the feed rail 16 is for instance in the order of 15–20 bar the pressure affecting the control valve increases so as to be in the order of 80–100 bar after closing of the solenoid valve 25 and the non-return valve 23.

The ratio of the volume of the feed duct (or hammer pipe) to the volume of the duct segment (or servo block) 22*a* is typically in the range 9:1 to 12:1. In this case, the pressure medium in the feed duct will generally have sufficient kinetic energy for proper operation.

Naturally, also other kinds of solutions for arranging the duct 20 to require only a little space are feasible. Accordingly, the duct 20 may also be arranged in a separate unit to be fixed to the body 3 and it may be designed in several ways, for instance as to and fro running loops, it being necessary only that the design should not impede the desired flow of the pressure medium.

Since the pressure medium controlling the operation of the valve 11, being advantageously oil, forms a flow circuit that is independent on the fuel to be injected into the cylinder by the injection pump, the actual fuel can be, if required, for instance heavy fuel oil, which, when also utilized for the operation of the control valve, could solidify especially during interrupted operation of the engine and impede the operation of the control valve. In addition to the injection of fuel the arrangement can with advantage be adapted to the feed control of other pressure media possibly to be injected into the combustion chamber of a cylinder of an engine, such as water, liquified ammonia, urea or the like. The purpose of feeding of these media is to affect the combustion process so that as a consequence thereof noxious substances like nitrogen oxides, NOx, would be created less than before.

So the invention is not limited to the embodiment shown, but several modifications are feasible within the scope of the accompanying claims.

We claim:

1. An arrangement for an injection pump in an internal combustion engine, especially a large diesel engine, in which the injection pump (2) is provided with a pressure medium controlled feed control valve (11), the flow circuit of which includes a pressure medium source (14), from which pressure medium is pumped through a delivery duct (16a) into a feed duct (17, 18, 20, 21, 22, 22*a*), which is provided with a non-return valve (23) and is connected to a pressure chamber (13) affecting said control valve (11) and to a spill passage (24) to be switched off by means of a solenoid valve (25), whereby closing of the solenoid valve (25) is arranged to provide a pressure increase in the pressure chamber (13) and, thus, a change of the state of the control valve (11), characterized in that said feed duct (17,18,20,21,22,22*a*) between the delivery duct (16*a*) and the control valve (11) is dimensioned to be long and narrow and is arranged at least to its main part to be a stationary part of the injection pump (2), of its supporting construction (3) or of a stationary construction unit attached to the injection pump or its supporting construction.

2. An arrangement according to claim 1, characterized in that said feed duct (17, 18, 20, 21, 22, 22*a*) is dimensioned so that the volume flow rate of the pressure medium therethrough is 5.5–16 l/min and the flow speeds are in the average 7–22 m/s depending on the dimensions in the different parts of the feed duct (17, 18, 20, 21, 22, 22*a*).

3. An arrangement according to claim 1, characterized in that an essential part of the total length of the feed duct (17, 18, 20, 21, 22, 22*a*) is designed to be arcuate in order to provide a compact assembly.

4. An arrangement according to claim 1, characterized in that said feed duct (17, 18, 20, 21, 22, 22*a*) is to its substantial part (20) formed between two surfaces for instance through milling.

5. An arrangement according to claim 1, characterized in that the shape of said feed duct (20) is substantially helical and is arranged between the boundary surfaces of two pipe-like elements (4, 19) arranged in a telescopic manner inside one another.

6. An arrangement according to claim 1, characterized in that said feed duct (17, 18, 20, 21, 22, 22*a*) comprises a set of at least substantially linear parts, which are joined together in the direction of flow by means of arcuate parts.

7. An arrangement according to claim 1, adapted to a large diesel engine comprising several cylinders, which are provided with a separate fuel injection pump (2) of their own including a control valve (11) and being assembled to be a stationary part of a so-called console support (1) in the engine, which is arranged to support the injection pump units (2), which are arranged in successive order and connected to each other and include a common fuel feed pipe (4, 4') and additionally a common fuel return pipe (5) with separate connecting ducts to each fuel injection pump (2), whereby the pressure medium is arranged to be fed through said delivery duct (16*a*) into the pressure medium circuit of each control valve (11), characterized in that a separate pipe element (19) is arranged within the fuel feed pipe (4) or within the fuel return pipe (5) included in the console support (1) so that a part (20) of said feed duct (17, 18, 20, 21, 22, 22*a*) for the control valve is arranged in a helical manner around the pipe element (19) at the boundary surface between the pipe element (19) and the fuel pipe (4, 5) in question.

8. An arrangement according to claim 7, characterized in that the inner part of said pipe element (19) serves as a fuel duct (4a) inside of the fuel pipe (4) and in that said feed duct (20) is sealed from the fuel duct (4*a*) preferably by means of ring seals (26, 27).

9. An arrangement according to claim 7, characterized in that said delivery duct (16*a*) is included in a separate feed rail (16), known as such and extending in the direction of the console support (1) and by means of which the pressure medium is arranged to be led from a common pressure medium source (14) into the feed duct (17, 18, 20, 21, 22, 22*a*) of each control valve, and in that the feed opening (18) of said feed duct (17,18,20,21,22,22*a*) is arranged with regard to the fuel injection pump (2) at the side of said feed rail (16).

10. An arrangement according to claim 7, characterized in that the body (3) of the fuel injection pump (2) supported to the console support (1) is provided with bores (21, 22, 22*a*) for leading pressure medium from the part (20) of the feed duct associated with the pipe element (19) into the solenoid valve (25).

11. An arrangement according to claim 7, characterized in that also the non-return valve (23) is arranged in the body (3) of the fuel injection pump.

12. An arrangement according to claim 1, characterized in that oil, especially engine oil, is utilized as pressure medium, and in that from the control valve (11) the oil is led through a separate passage (24) into the vicinity of a roll follower (10) in the fuel pump for providing extra lubrication before recovery and recirculation.

13. An internal combustion engine including a fuel injection pump provided with a pressure-responsive feed control valve, a feed duct which is provided with a non-return valve and is connected to a pressure chamber of the feed control valve, a pressure medium pump for supplying pressure medium to the pressure chamber by way of the feed duct, and a solenoid valve connected between the feed duct and a spill passage, whereby closing of the solenoid valve generates a pressure pulse in the pressure chamber for opening the feed control valve, and wherein the feed duct is long and narrow and at least a substantial part of the feed duct is constructed as a unitary part of the injection pump or of a stationary structure to which the pump is attached.

14. An arrangement according to claim 13, wherein at least a substantial part of the feed duct is integrated into the injection pump or a stationary structure to which the pump is attached.

* * * * *